US006409312B1

(12) United States Patent
Mrvos et al.

(10) Patent No.: US 6,409,312 B1
(45) Date of Patent: Jun. 25, 2002

(54) INK JET PRINTER NOZZLE PLATE AND PROCESS THEREFOR

(75) Inventors: James Michael Mrvos, Lexington; Carl Edmond Sullivan, Stamping Ground; Gary Raymond Williams, Lexington, all of KY (US)

(73) Assignee: Lexmark International, Inc., Lexington, NY (US)

( * ) Notice: Subject to any disclaimer, the term of this patent is extended or adjusted under 35 U.S.C. 154(b) by 0 days.

(21) Appl. No.: 09/818,736

(22) Filed: Mar. 27, 2001

(51) Int. Cl.[7] ..... B41J 2/04
(52) U.S. Cl. ..... 347/54
(58) Field of Search ..... 347/54, 68, 69, 347/70, 71, 50, 40, 74, 77, 76, 49, 73; 399/261; 361/700; 29/890.1; 310/328–330

(56) References Cited

U.S. PATENT DOCUMENTS

| | | | |
|---|---|---|---|
| 3,506,441 | A | 4/1970 | Gottfried |
| 3,751,248 | A | 8/1973 | Goell |
| 3,991,231 | A | 11/1976 | Trausch |
| 4,489,146 | A | 12/1984 | Bock et al. |
| 4,528,577 | A | 7/1985 | Cloutier et al. |
| 4,572,764 | A | 2/1986 | Fan |
| 4,591,547 | A | 5/1986 | Brownell |
| 4,619,731 | A | 10/1986 | Buttry et al. |
| 4,770,739 | A | 9/1988 | Orvek et al. |
| 4,786,357 | A | 11/1988 | Campanelli et al. |
| 4,826,564 | A | 5/1989 | Desilets et al. |
| 5,006,202 | A | 4/1991 | Hawkins et al. |
| 5,112,434 | A | 5/1992 | Goldberg |
| 5,126,231 | A | 6/1992 | Levy |
| 5,263,250 | A | 11/1993 | Nishiwaki et al. |
| 5,328,560 | A | 7/1994 | Hanawa et al. |
| 5,331,344 | A | 7/1994 | Miyagawa et al. |
| 5,378,309 | A | 1/1995 | Rabinzohn |
| 5,417,799 | A | 5/1995 | Daley et al. |
| 5,437,763 | A | 8/1995 | Huang |
| 5,443,942 | A | 8/1995 | Imamura |
| 5,458,254 | A | 10/1995 | Miyagawa et al. |
| 5,478,606 | A | 12/1995 | Ohkuma et al. |
| 5,509,553 | A | 4/1996 | Hunter, Jr. et al. |
| 5,560,837 | A | 10/1996 | Trueba |
| 5,667,940 | A | 9/1997 | Hsue et al. |
| 5,741,624 | A | 4/1998 | Jeng et al. |
| 5,851,734 | A | 12/1998 | Pierrat |
| 5,859,655 | A | 1/1999 | Gelorme et al. |
| 5,869,175 | A | 2/1999 | Sardella |
| 5,942,373 | A | 8/1999 | Chou et al. |
| 5,958,800 | A | 9/1999 | Yu et al. |
| 5,985,521 | A | 11/1999 | Hirano et al. |
| 6,008,135 | A | 12/1999 | Oh et al. |
| 6,016,601 | A | 1/2000 | Takemoto et al. |
| 6,022,752 | A | 2/2000 | Hirsh et al. |
| 6,041,501 | A | 3/2000 | Suzuki et al. |

OTHER PUBLICATIONS

Erno H. Klaassen Et Al., "MEMS Devices Through Deep Rective IOn Etching of Single–Crystal Silicon," Stanford University. Electrical Engineering Department (San Jose, CA), p. 2, (Jul. 28, 2000).

*Primary Examiner*—Raquel Yvette Gordon
(74) *Attorney, Agent, or Firm*—Luedeka, Neely & Graham

(57) ABSTRACT

The invention provides a printhead for an ink jet printer and a method for making a printhead for an ink jet printer. The printhead includes a semiconductor substrate containing ink ejection devices and a dry-etched ink via therein. A first photo-imaged polymer layer is applied to the semiconductor substrate, the first photo-imaged polymer layer being patterned and developed to contain ink flow chambers and ink flow channels corresponding to the ink ejection devices on the semiconductor substrate. A second photo-imaged polymer layer is applied to the first photo-imaged polymer layer. The second photo-imaged polymer layer is patterned and developed to contain nozzle holes corresponding to the ink chambers in the first photo-imaged polymer layer and corresponding to the ink ejection devices on the semiconductor substrate. The invention provides increased printhead manufacturing accuracy and elimination of alignment and adhesive attachment of a separate nozzle plate to an ink jet heater chip.

24 Claims, 6 Drawing Sheets

INK JET PRINTER NOZZLE PLATE AND PROCESS THEREFOR

FIELD OF THE INVENTION

The invention relates to ink jet printers, to an improved nozzle plate for an ink jet printer and method for making the nozzle plate.

BACKGROUND

Ink jet printers continue to be improved as the technology for making the printheads continues to advance. New techniques are constantly being developed to provide low cost, highly reliable printers which approach the speed and quality of laser printers. An added benefit of ink jet printers is that color images can be produced at a fraction of the cost of laser printers with as good or better print quality than laser printers. All of the foregoing benefits exhibited by ink jet printers have also increased the competitiveness of suppliers to provide comparable printers in a more cost efficient manner than their competitors.

One area of improvement in the printers is in the print engine or printhead itself. This seemingly simple device is a relatively complicated structure containing electrical circuits, ink passageways and a variety of tiny parts assembled with precision to provide a powerful, yet versatile ink jet pen. The components of the pen must cooperate with each other and with a variety of ink formulations to provide the desired print properties. Accordingly, it is important to match the printhead components to the ink and the duty cycle demanded by the printer. Slight variations in production quality can have a tremendous influence on the product yield and resulting printer performance.

The primary components of the ink jet printhead are a semiconductor chip, a nozzle plate and a flexible circuit attached to the chip. The semiconductor chip is preferably made of silicon and contains various passivation layers, conductive metal layers, resistive layers, insulative layers and protective layers deposited on a device side thereof. For thermal ink jet printers, individual heater resistors are defined in the resistive layers and each heater resistor corresponds to a nozzle hole in the nozzle plate for heating and ejecting ink toward a print media.

The nozzle plates typically contain hundreds of microscopic nozzle holes for ejecting ink toward a print media. Separate nozzle plates are usually fabricated using laser ablation or other micro-machining techniques and are attached to the chips on a multi-chip wafer so that the nozzle holes align with the heater resistors. Each nozzle plate is individually attached to a corresponding chip on the wafer using an adhesive and the adhesive is cured.

Ink chambers and ink feed channels for directing ink to each of the ejection devices on the semiconductor chip are either formed in the nozzle plate material or in a separate thick film layer. In a center feed design for a top-shooter type printhead, ink is supplied to the ink channels and ink chambers from a slot or ink via which is conventionally formed by chemically etching or grit blasting through the thickness of the semiconductor chip. The chip, nozzle plate and flexible circuit assembly is typically bonded to a thermoplastic body using a heat curable and/or radiation curable adhesive to provide an ink jet pen.

The equipment used to form the nozzle plates and attach the nozzle plates to the chips is expensive and requires that close manufacturing tolerances be used. In order to decrease the cost of the printheads, newer manufacturing techniques using less expensive equipment is desirable. These techniques, however, must be able to produce printheads suitable for the increased quality and speed demanded by consumers. Thus, there continues to be a need for manufacturing processes and techniques which provide improved printhead components.

SUMMARY OF THE INVENTION

The invention provides a printhead for an ink jet printer and a method for making a printhead for an ink jet printer. The printhead includes a semiconductor substrate containing ink ejection devices and a dry-etched ink via therein for flow of ink from an ink supply to the ink ejection devices. A first photo-imaged polymer layer is applied to the semiconductor substrate, the first photo-imaged polymer layer being patterned and developed to contain ink flow chambers and ink flow channels corresponding to the ink ejection devices on the semiconductor substrate. A second photo-imaged polymer layer is applied to the first photo-imaged polymer layer. The second photo-imaged polymer layer is patterned and developed to contain nozzle holes corresponding to the ink chambers in the first photo-imaged polymer layer and corresponding to the ink ejection devices on the semiconductor substrate.

In another aspect the invention provides a method for making a printhead for an ink jet printer. The method includes providing a plurality of semiconductor devices on a silicon wafer, the wafer having a first surface and a second surface, the first surface containing ink ejection devices thereon. A first photo-imageable polymer layer is applied to the first surface of the silicon wafer and the first polymer layer is exposed to sufficient light radiation energy to provide a latent image of ink chambers and ink flow channels therein corresponding to the ink ejection devices. A second photo-imageable polymer layer is applied to the first photo-imageable polymer layer and the second polymer layer is exposed to sufficient light radiation energy to provide a latent image of nozzle holes therein corresponding to the ink ejection devices. A masking layer is applied to the second surface of the silicon wafer. The masking layer is exposed and developed to provide ink via patterns to be etched in the silicon wafer. The ink via patterns are dry etched through the silicon wafer up to the first polymer layer to form at least one ink via per semiconductor substrate. The latent images in the first and second polymer layers are developed to provide ink flow features and nozzles in the first and second polymer layers. The wafer containing the developed polymer layers is diced to provide a plurality of nozzle plate/substrate assemblies. At least one nozzle plate/substrate assembly containing the first and second developed polymer layers is attached to an electrical circuit and a printhead body to form an ink jet printhead.

In yet another aspect the invention provides a method for making a printhead for an ink jet printer. The method includes providing a semiconductor wafer containing a plurality of printhead chips, the wafer having a device surface and a second surface opposite the device surface. A first negative photoimageable material is applied to the device surface of the wafer. The first negative photoimageable material is dried to provide a first polymer layer. The first polymer layer is exposed to light radiation energy through a mask to provide exposed and unexposed areas of the first polymer layer. The unexposed areas are removed from the first polymer layer to provide ink channels and ink chambers in the first polymer layer. A positive photoresist material is applied to the first polymer layer to fill the ink channels and ink chambers in the first polymer layer. The positive photoresist material is exposed to light radiation energy to provide unexposed areas filling the ink chambers and ink channels and to provide exposed areas of the positive photoresist material. The exposed areas of the positive photoresist layer are removed from the first polymer layer. A second negative photoimageable material is applied to the first polymer layer and to the unexposed positive photoresist material. The second photoimageable material is dried to provide a second polymer layer. The second polymer is exposed to light radiation energy through a mask to provide unexposed areas corresponding to nozzle hole locations in the second polymer layer. The unexposed areas are removed from the second polymer layer to provide nozzle holes in the second polymer layer. A masking layer is applied to the second surface of the silicon wafer. The masking layer is exposed and developed to provide ink via patterns to be etched in the silicon wafer. The ink via patterns are dry etched through the silicon wafer up to the first polymer layer to form at least one ink via per semiconductor substrate. The positive photoresist material filling the ink channels and ink chambers is then removed from the wafer. The wafer is diced to provide a plurality of nozzle plate/chip assemblies. Flexible circuits or tape automated bonding (TAB) circuits are connected to the nozzle plate/chip assemblies to provide a plurality of printhead assemblies. At least one of the printhead assemblies is attached to a printhead body to provide an ink jet printhead.

An advantage of the invention is that it provides an improved printhead structure and method for making the printhead structure so as to avoid forming then attaching individual nozzle plates to a semiconductor substrate. Because the nozzle plate attaching step is avoided, alignment of the flow features in the nozzle plate with the ink ejection devices on the semiconductor substrate is greatly improved. Furthermore, because dry-etching is used to form the ink vias in the wafer, the ink vias may be formed after the first and second polymer layers are applied to the wafer. The invention also enables production of printhead devices having variable nozzle plate thicknesses without substantially affecting the planarity of the nozzle plate chip assembly.

BRIEF DESCRIPTION OF THE DRAWINGS

Further features and advantages of the invention will become apparent by reference to the detailed description when considered in conjunction with the figures, which are not to scale, wherein like reference numbers indicate like elements through the several views, and wherein.

DETAILED DESCRIPTION OF THE INVENTION

Figure 1:
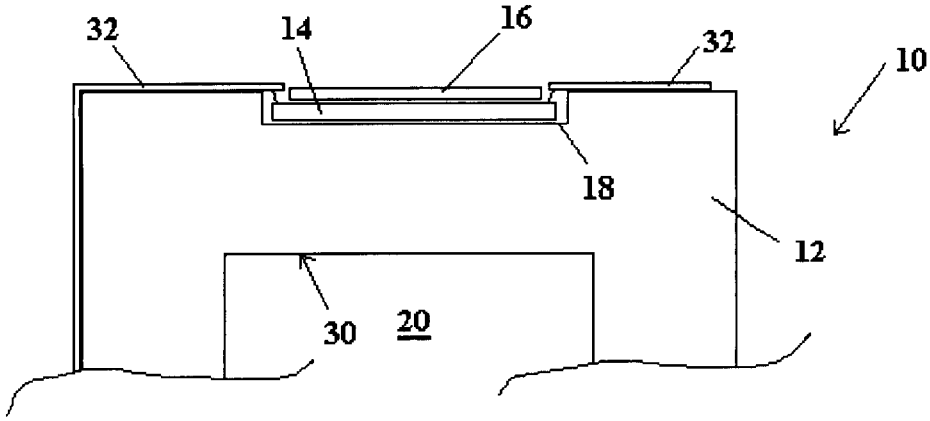
Fig. 1 Prior Art
FIG. 1 is a side view representation through a portion of an ink jet printhead including a printhead body and a nozzle plate/substrate assembly.

With reference to FIG. 1, there is shown a representation of a portion of an ink jet printhead 10 viewed from one side depicting a printhead body 12 containing a semiconductor substrate 14 and a nozzle plate 16. For conventional ink jet printheads, the nozzle plate 16 is formed in a film, excised from the film and attached as a separate component to the semiconductor substrate 14 using an adhesive. The substrate/nozzle plate assembly 14/16 is attached in a chip pocket 18 in the printhead body 12 to form the printhead 10. Ink is supplied to the substrate/nozzle plate assembly 14/16 from an ink reservoir 20 in the printhead body generally opposite the chip pocket 18.

The printhead body 12 is preferably made of a metal or a polymeric material selected from the group consisting of amorphous thermoplastic polyetherimide available from G.E. Plastics of Huntersville, N.C. under the trade name ULTEM 1010, glass filled thermoplastic polyethylene terephthalate resin available from E. I. du Pont de Nemours and Company of Wilmington, Del. under the trade name RYNITE, syndiotactic polystyrene containing glass fiber available from Dow Chemical Company of Midland, Mich. under the trade name QUESTRA, polyphenylene oxide/high impact polystyrene resin blend available from G.E. Plastics under the trade names NORYL SE1 and polyamide/polyphenylene ether resin available from G.E. Plastics under the trade name NORYL GTX. A preferred polymeric material for making the printhead body is NORYL SE1 polymer.

Figure 2:
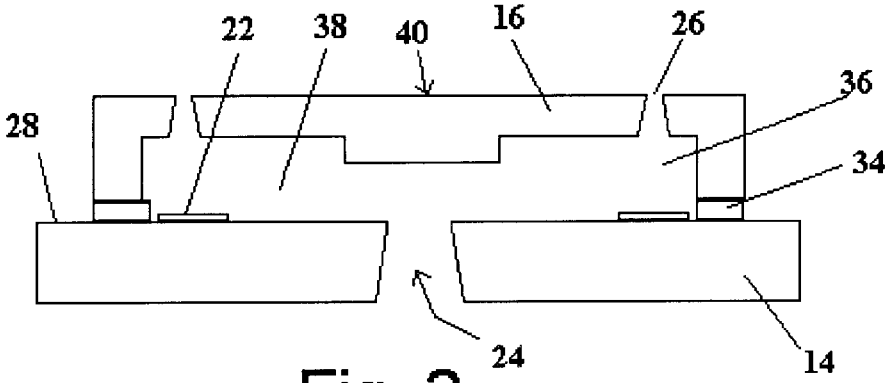
Fig. 2 Prior Art
FIG. 2 is an enlarged end view representation of a prior art ink jet heater chip and nozzle plate assembly.

The semiconductor substrate 14 is preferably a silicon semiconductor substrate containing a plurality of ink ejection devices such as piezoelectric devices or heater resistors 22 formed on a device side 28 thereof (FIG. 2). Upon activation of heater resistors 22, ink supplied through an ink via 24 in the semiconductor substrate 14 is caused to be ejected toward a print media through nozzle holes 26 in nozzle plate 16. Ink ejection devices such as heater resistors 22 are formed on the device side 28 of the semiconductor substrate 14 by well known semiconductor manufacturing techniques.

The semiconductor substrates 14 are relatively small in size and typically have overall dimensions ranging from about 2 to about 8 millimeters wide by about 10 to about 20 millimeters long and from about 0.4 to about 0.8 mm thick. In conventional semiconductor substrates 14, slot-type ink vias 24 are grit-blasted in the semiconductor substrates 14. Such vias 24 typically have dimensions of about 10 millimeters long and 0.40 millimeters wide. In a preferred embodiment according to the invention, the ink via 24 may be provided by single slot or a plurality of openings in the substrate 14 made by a dry etch process selected from reactive ion etching (RIE) or deep reactive ion etching (DRIE—also known as Inductive Coupled Plasma (ICP)), described in more detail below.

The ink vias 24 direct ink from an ink reservoir 20 which is located adjacent to ink surface 30 of the printhead body 12 through a passage-way in the printhead body 12 and the ink via 24 in the semiconductor substrate 14 to the device side 28 of the substrate 14 containing heater resistors 22 (FIGS. 1 and 2). The device side 28 of the substrate 14 also preferably contains electrical tracing from the heater resistors 22 to contact pads used for connecting the substrate 14 to a flexible circuit or a tape automated bonding (TAB) circuit 32 (FIG. 1) for supplying electrical impulses from a printer controller to activate one or more heater resistors 22 on the substrate 14.

Prior to attaching the substrate 14 to the printhead body 12, nozzle plate 16 is attached to the device side 28 of the substrate by use of one or more adhesives 34. The adhesive 34 used to attach the nozzle plate 16 to the substrate 14 is preferably a heat curable adhesive such as a B-stageable thermal cure resin including, but not limited to phenolic resins, resorcinol resins, epoxy resins, ethylene-urea resins, furane resins, polyurethane resins and silicone resins. A particularly preferred adhesive 34 for attaching the nozzle plate 16 to the substrate 14 is a phenolic butyral adhesive which is cured using heat and pressure. The nozzle plate adhesive 34 is preferably cured before attaching the substrate/nozzle plate assembly 14/16 to the printhead body 12.

As shown in detail in FIG. 2, a conventional nozzle plate 16 contains a plurality of the nozzle holes 26 each of which are in fluid flow communication with an ink chamber 36 and an ink supply channel 38 which are formed in the nozzle plate material from the side to be attached to the semiconductor substrate 14 by means such as laser ablation. After laser ablating the nozzle plate 16, the nozzle plate 16 must be washed to remove debris therefrom. Such nozzle plates 16 are typically comprised of polyimide which may contain an ink repellent coating on a surface 40 thereof. Nozzle plates 16 are made from a continuous polyimide film containing the adhesive 34. The film is preferably either about 25 or about 50 mm thick and the adhesive is about 12.5 mm thick. The thickness of the film is fixed by the manufacturer thereof. After forming flow features in the film for individual nozzle plates 16, the nozzle plates 16 are excised from the film.

The excised nozzle plates 16 are attached to a wafer containing a plurality of semiconductor substrates 14. An automated device is used to optically align the nozzle holes 26 in each nozzle plates 16 with heater resistors 22 on a semiconductor substrate 14 and attach the nozzle plates 16 to the semiconductor substrates 14. Misalignment between the nozzle holes 26 and the heater resistors 22 may cause problems such as misdirection of ink droplets from the printhead 10, inadequate droplet volume or insufficient droplet velocity. The laser ablation equipment and automated nozzle plate attachment devices are costly to purchase and maintain. Furthermore it is often difficult to maintain manufacturing tolerances using such equipment in a high speed production process. Slight variations in the manufacture of each unassembled component are magnified significantly when coupled with machine alignment tolerances to decrease the yield of printhead assemblies.

The invention, as set forth therein, greatly improves alignment between the nozzle holes 26 and the heater resistors 22 and uses less costly equipment thereby providing an advantage over conventional ink jet printhead manufacturing processes. The invention also provides for variations in nozzle plate thicknesses which thicknesses are not limited by available film materials.

Figure 3:
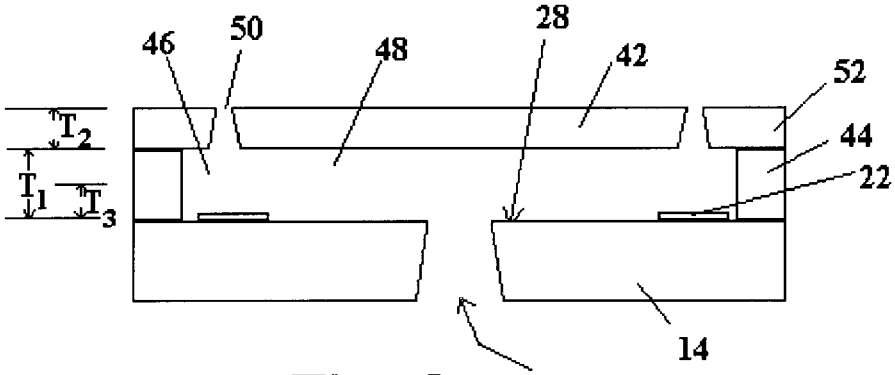
FIG. 3 an enlarged end view representation of an ink jet nozzle plate/substrate assembly according to the invention.
Figure 4:
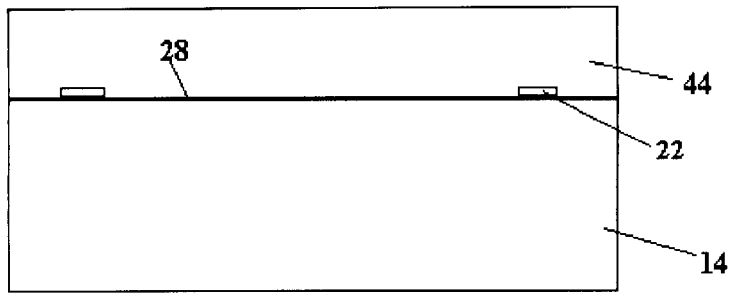
FIGS. 4–9 are schematic representations of steps in a process to make an ink jet nozzle plate/substrate assembly according to the invention.
Figure 5:
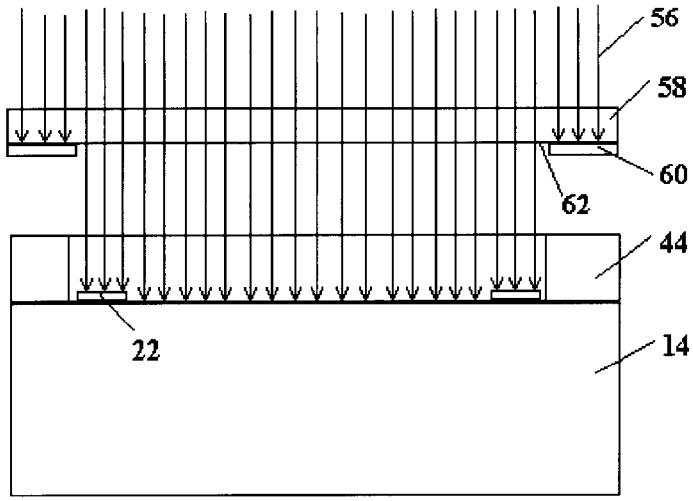

A nozzle plate/substrate assembly 42/14 according to the invention is illustrated in FIG. 3. Flow features are provided in a first photo-imaged polymer layer 44 which is preferably spin-coated onto the chip 14 from a solution thereof or laminated to the chip 14 as a dry film. The flow features include ink chambers 46 and ink channels 48. The nozzle plate 42 of the assembly 42/14 has a plurality of the nozzle holes 50 formed in a second photo-imaged polymer layer 52 which is spin-coated onto the first polymer layer 44. A third photo-imaged polymer layer may be spin-coated or laminated onto the semiconductor substrate in order to provide the ink channels 48 rather than forming all of the flow features in the first polymer layer 44.

The photo-imaged polymer layers 44 and 52 applied to the chip 14 are preferably made from a positive or negative photoresist material. Such materials include, but are not limited to acrylic and epoxy-based photoresists such as the photoresist materials available from Clariant Corporation of Somerville, N.J. under the trade names AZ4620 and AZ1512. Other photoresist materials are available from Shell Chemical Company of Houston, Tex. under the trade name EPON SU8 and photoresist materials available from Olin Hunt Specialty Products, Inc. which is a subsidiary of the Olin Corporation of West Paterson, N.J. under the trade name WAYCOAT. A preferred photoresist material includes from about 10 to about 20 percent by weight difunctional epoxy compound, less than about 4.5 percent by weight multifunctional crosslinking epoxy compound, from about 1 to about 10 percent by weight photoinitiator capable of generating a cation and from about 20 to about 90 percent by weight non-photoreactive solvent as described in U.S. Pat. No. 5,907,333 to Patil et al., the disclosure of which is incorporated by reference herein as if fully set forth.

Because the first and second polymer layers 44 and 52 are preferably spin-coated onto the semiconductor substrate 14 from a solution containing the photoresist material, the thicknesses $T_1$ and $T_2$ of the polymer layers 44 and 52 may be varied within wide limits. Accordingly, polymer layers 44 and 52 may be provided with thickness' $T_1$ and $T_2$, each ranging from about 2 to about 75 microns. Unlike adhesive attachment techniques for film-type nozzle plates, spin-coating techniques also provide substantially planar layers 44 and 52 regardless of the thickness of the layers and the planarity of the device side 28 of the semiconductor substrate 14. Film-type nozzle plates, such as nozzle plate 16 (FIG. 2) often conform to the irregularities on the device side 28 of the semiconductor substrates 14 to which they are attached providing restricted or misdirected ink flow from nozzle holes 26.

The invention also provides a process for making a nozzle plate/substrate assembly 42/14 having the features and advantages described above. An important feature of the process of the invention is that temporarily filling the ink via 24 in the semiconductor substrate 14 is not required, since the process enables formation of the ink via 24 after the polymer layers 44 and 52 have been spin-coated onto the semiconductor substrate 14. In a conventional spin-coating process, any holes or slots in the semiconductor substrate 14 must be filled with a removable material because conventional spin-coaters use a vacuum to hold the substrate 14 on the coater as the photoresist solution is spin-coated onto the device side 28 of the substrate 14. If the via 24 is not filled, it is extremely difficult to apply layers 44 and 52 evenly to the device side 28 of substrate 14. It is also difficult to completely remove the removable material from via 24 after a photoresist material is spin-coated onto the substrate 14. The invention solves these problems and difficulties by forming via 24 using a dry-etching process or grit blasting after the layers 44 and 52 have been spin-coated onto substrate 14.

The process for making the nozzle plate/substrate assembly 42/14 will now be described with reference to FIGS. 4–9. In the first step of the process, a first photo-imageable polymer layer 44 is spin-coated onto the device side 28 of a semiconductor substrate 14 containing electrical devices such as heater resistors 22. The first photo-imageable polymer layer 44 is preferably a positive resist layer. Next, the first layer 44 is exposed to a light source such as ultraviolet (UV) radiation 56 through a first mask 58 having opaque areas 60 and transparent areas 62 and/or partially transparent areas, i.e., a graded mask or gray scale mask. In the alternative, a third photoresist polymer layer may be spin-coated onto the device side of the substrate 28, exposed and developed to provide part of the flow channel 48 (FIG. 3) rather than forming all of the flow features in the first polymer layer 44. The light source preferably has radiation energy sufficient to react with the exposed portions 66 (FIG. 6) of the polymer layer 44.

Figure 6:
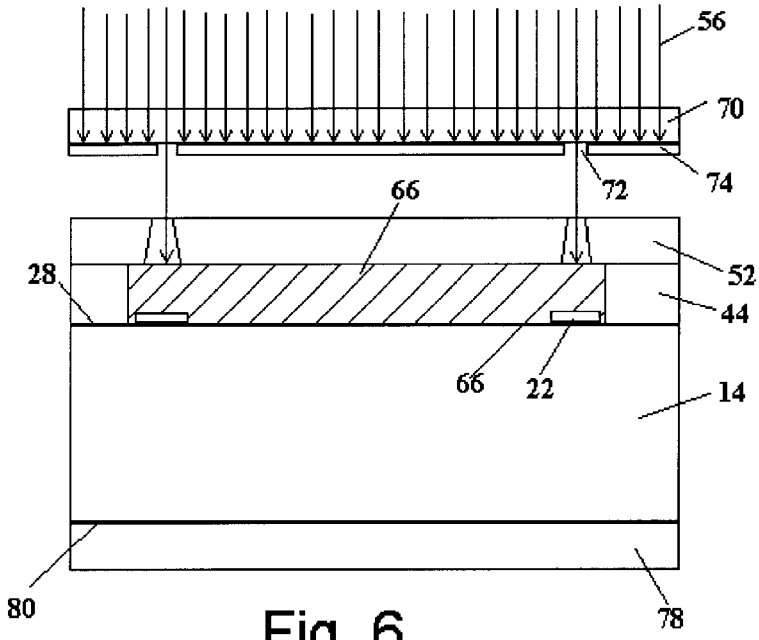
Figure 6A:
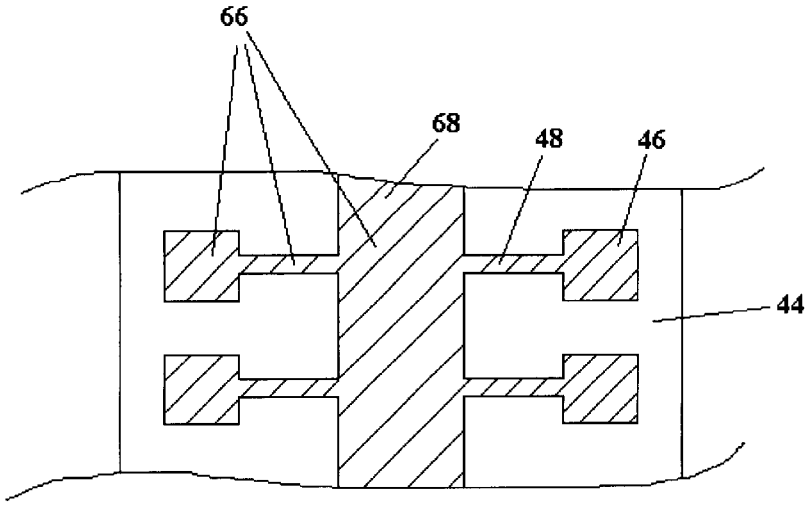
Figure 7:
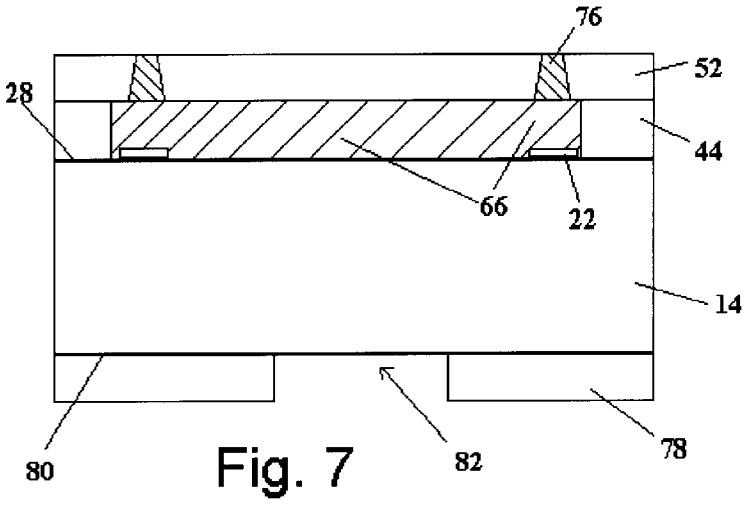
Figure 8:
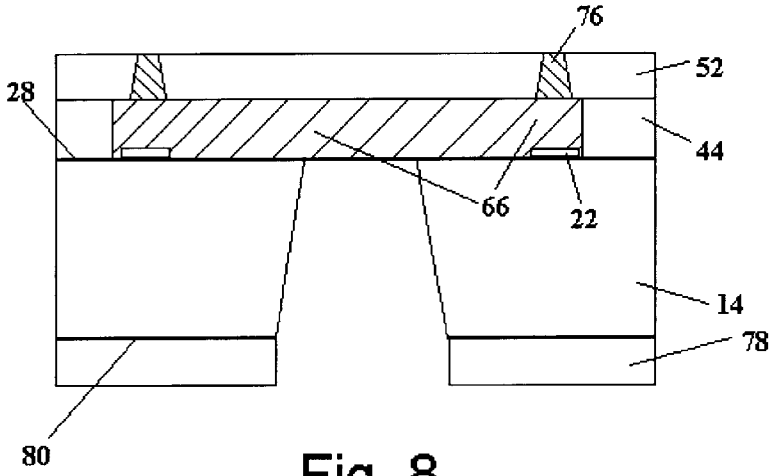

The exposed portions 66 are seen in plan view in FIG. 6A. The first layer 44 is exposed to provide locations for ink chambers 46, ink channels 48 and an ink supply area 68 which provides ink from an ink via 24 (FIG. 3) to the ink channels 48 and ink chambers 46. The ink supply area may contain additional features such as filter structures to reduce the amount of particles entering the ink channels 48 which particles may be sufficient to block the flow of ink in the ink channels 48.

Before the exposed portions 66 are developed, the second photo-imageable polymer layer 52 is applied to the first photo-imageable polymer layer 44 using a spin-coating technique as described above. The second photoimageable polymer layer 52 is exposed to a light source such as the UV radiation 56 through a second mask 70 having transparent areas 72 and opaque areas 74 to provide exposed areas 76 (FIG. 7) in the second polymer layer 52.

A masking layer 78 of silicon dioxide, a photosensitive polymer, a photoresist layer, a metal layer or a metal oxide layer, i.e., tantalum, tantalum oxide and the like is preferably applied to a second side 80 of the semiconductor substrate 14 opposite the device side 28. The masking layer 78 may be applied to the second side 80 before or after applying the first polymer layer 44, the second polymer layer 52 or exposing the first or second polymer layers to UV radiation 56. It is preferred to apply the masking layer 78 to the second side 80 of the semiconductor substrate 14 prior to applying the first and second polymer layers 44 and 52 to the device side 28 of the semiconductor substrate. If masking layer 78 is silicon dioxide, the silicon dioxide layer may be applied to the semiconductor substrate 14 by a thermal growth method, a chemical vapor deposition process such as PECVD, sputtering or spin-coating. For a silicon dioxide layer, an etching step may be used to provide via location 82 in the masking layer 78. A photoresist material may be applied to the semiconductor substrate 14 as a masking layer 78 by spin-coating the photoresist material onto the second side 80 of the substrate 14. The photoresist or photosensitive material may be exposed and developed as described above to provide ink via location 82. The masking layer 78 preferably has a thickness ranging from about 0.1 to about 35 microns.

Prior to developing exposed areas 66 and 76 in the first and second polymer layers 44 and 52, the semiconductor substrate 14 is dry etched using reactive ion etching (RIE) or deep reactive ion etching (DRIE) to form ink via 24 through the semiconductor substrate material 14 from side 80 to device side 28 up to the first polymer layer 44. Because the first polymer layer 44 has not yet been developed in exposed area 66, the first polymer layer 44 provides an etch stop for the RIE or DRIE process and terminates the RIE or DRIE process at device side 28 of the semiconductor substrate 14 without damaging critical flow features in polymer layer 44. The exposed area 66 may be partially removed by the RIE or DRIE etching, since it will be completely removed in a subsequent developing step.

In order to form ink via 24, the semiconductor substrate 14 containing the patterned masking layer 78 is preferably placed in an etch chamber having a source of plasma gas and back side cooling such as with helium, water or liquid nitrogen. It is preferred to maintain the semiconductor substrate 14 below about 185° C., most preferably in a range of from about 50° to about 80° C. during the etching process. In the preferred etching process, a deep reactive ion etch (DRIE) of the substrate is conducted using an etching plasma derived from $SF_6$ and a passivating plasma derived from $C_4F_8$ wherein the semiconductor substrate 14 is etched from the second side 80 toward the device side 28.

During the etching process, the plasma is cycled between the passivating plasma step and the etching plasma step until the via 24 is etched completely through the substrate 14 from the second side 80 to the device side 28. Cycling times for each step preferably range from about 5 to about 20 seconds per step. Gas pressure in the etching chamber preferably ranges from about 15 to about 50 millitorr at a temperature ranging from about −20° to about 35° C. The DRIE platen power preferably ranges from about 10 to about 25 watts and the coil power preferably ranges from about 800 watts to about 3.5 kilowatts at frequencies ranging from about 10 to about 15 MHz. Etch rates may range from about 2 to about 10 microns per minute or more and produce vias having side wall profile angles ranging from about 88° to about 92°. Dry-etching apparatus suitable for forming ink vias 24 is available from Surface Technology Systems, Ltd. of Gwent, Wales. Procedures and equipment for etching silicon are described in European Application No. 838,839A2 to Bhardwaj, et al., U.S. Pat. No. 6,051,503 to Bhardwaj, et al., PCT application WO 00/26956 to Bhardwaj, et al.

Figure 9:
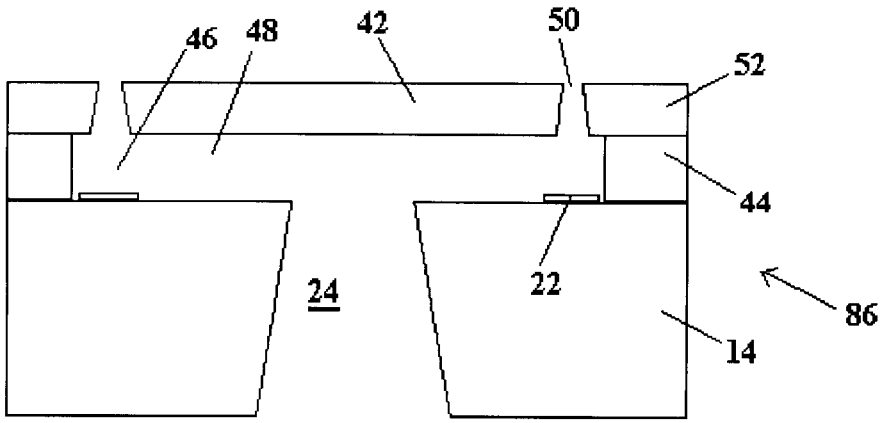

Once the via 24 is etched in the semiconductor substrate 14, the masking layer 78 may be removed from the substrate 14 by solvents, wet or dry chemical etching. Wet chemical etching may be conducted using acidic or basic solutions. The masking layer 78 may be removed before or after developing the exposed areas 66 and 76 in layers 44 and 52 such as by using HF or a buffered oxide etchant. The exposed areas 66 and 76 are developed out through the nozzle holes 50 and etched via 24 by conventional resist development means such as solvent stripping, wet etching or plasma ashing techniques. A preferred method for developing the exposed areas is use of butyl cellusolve acetate or butyl acetate. A nozzle plate/substrate assembly 86 made according to the foregoing procedure is illustrated in FIG. 9.

After developing the exposed areas 66 and 76 in layers 44 and 52, the nozzle plate/substrate assembly 86 is electrically connected to the flexible circuit or TAB circuit, such as TAB circuit 32 (FIG. 1) and the nozzle plate/substrate assembly 86 is attached to the printhead body 12 using a die attach adhesive. The nozzle plate/substrate assembly 86 preferably attached to the printhead body 12 in the chip pocket 18 as described above with reference to FIG. 1. The die attach adhesive preferably seals around the edges of the semiconductor substrate 14 to provide a substantially liquid tight seal to inhibit ink from flowing between edges of the substrate 14 and the chip pocket 18.

The die attach adhesive used to attach nozzle plate/substrate assembly 86 to the printhead body 12 is preferably an epoxy adhesive such as a die attach adhesive available from Emerson & Cuming of Monroe Township, N.J. under the trade name ECCOBOND 3193-17. In the case of a nozzle plate/substrate assembly 86 that requires a thermal conductive printhead body 12, the die attach adhesive is preferably a resin filled with thermal conductivity enhancers such as silver or boron nitride. A preferred thermally conductive die attach adhesive is POLY-SOLDER LT available from Alpha Metals of Cranston, R.I. A suitable die attach adhesive containing boron nitride fillers is available from Bryte Technologies of San Jose, Calif. under the trade designation G0063. The thickness of adhesive preferably ranges from about 25 microns to about 125 microns. Heat is typically required to cure the die attach adhesive and fixedly attach the nozzle plate/substrate assembly 86 to the printhead body 12.

Once the nozzle plate/substrate assembly 86 is attached to the printhead body 12, the flexible circuit or TAB circuit 32 is attached to the printhead body 12 as by use of a heat activated or pressure sensitive adhesive. Preferred pressure sensitive adhesives include, but are not limited to phenolic butyral adhesives, acrylic based pressure sensitive adhesives such as F-9460 PC available from 3M corporation of St. Paul, Minn. The pressure sensitive adhesive preferably has a thickness ranging from about 25 to about 200 microns.

Ejection of ink through the nozzle holes 50 is controlled by a print controller in the printer to which the printhead 10 is attached. Connections between the print controller and the heater resistors 22 of printhead 10 are provided by electrical traces which terminate in contact pads on the device side 28 of the semiconductor substrate 14. Electrical TAB bond or wire bond connections are made between the flexible circuit or TAB circuit 32 and the contact pads on the semiconductor substrate 14. An encapsulant material is used to protect the exposed edges of the TAB circuit and the TAB bond and/or wire bond connections. A preferred encapsulant included from about 0 to about 20 percent by weight of a multifunctional epoxy material such as a polyglycidyl ether of phenol-formaldehyde novolak resin, from about 80 to about 95 percent by weight of a difunctional epoxy material such as a bisphenol-A/epichlorohydrin epoxy resin, a catalytic amount of a photoinitiator such as an aromatic iodonium complex salt, a co-catalyst such as cupric benzoate and 2-hydroxy-1,2-diphenylethanone and a reactive diluent such as a silane adhesion promoter.

During a printing operation, an electrical impulse is provided from the printer controller to activate one or more of the heater resistors 22 thereby heating ink in the ink chamber 46 to vaporize a component of the ink thereby forcing ink through nozzle hole 50 toward a print media. Ink is caused to refill the ink channel 48 and ink chamber 46 by collapse of the bubble in the ink chamber once ink has been expelled through nozzle holes 50. The ink flows from the ink supply reservoir 20 (FIG. 1) through an ink feed slot in the printhead body 12 to the ink feed vias 24 in the semiconductor substrate 14.

Figure 10:
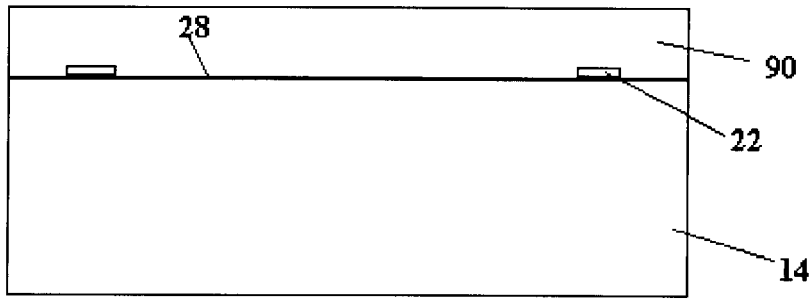
FIGS. 10–17 are schematic representations of steps in an alternative process for making an ink jet nozzle plate/substrate assembly according to the invention.

An alternative procedure for making an ink jet printhead according to the invention is now described with references to FIGS. 10–17. According to the alternative process, a first negative photoresist material is applied to the device surface 28 of a semiconductor wafer containing a plurality of printhead chips 14 by spin-coating or laminating the first negative photoresist material to the device surface 28 of the chip 14. If the first negative photoresist material is applied to surface 28 by spin-coating a liquid thereon, the liquid is dried to provide a first negative photo-imageable polymer layer 90 having a thickness ranging from about 2 to about 75 microns (FIG. 10).

Figure 11:
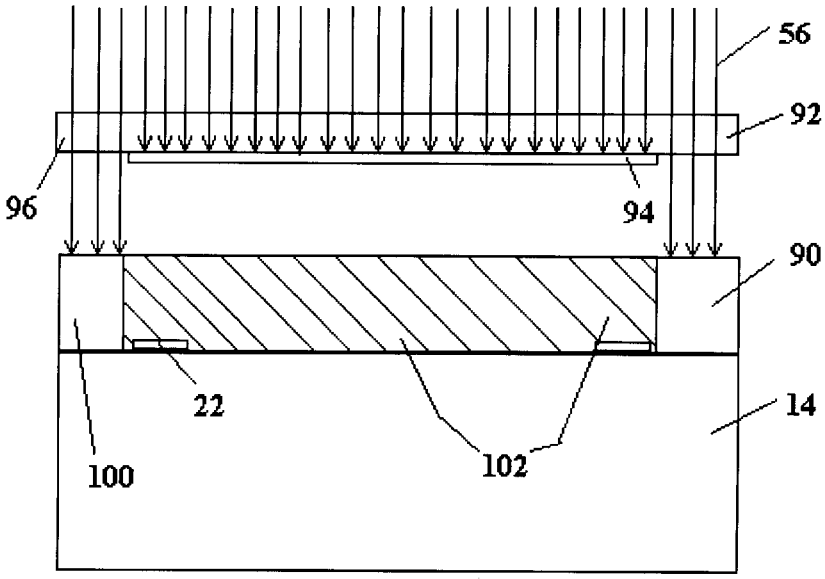
Figure 12:
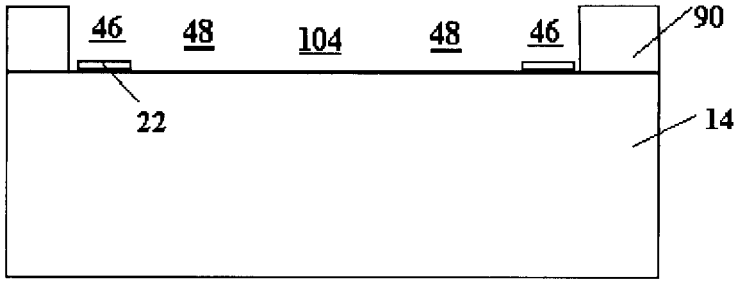

The first polymer layer 90 is exposed to light radiation energy such as ultraviolet (UV) radiation 56 through a mask 92 having opaque areas 94 and transparent areas 96 and/or partially transparent areas, i.e., a graded mask or gray scale mask to provide exposed areas 100, unexposed areas 102 in the first polymer layer 90 (FIG. 11). The unexposed areas 102 are removed from the first polymer layer 90 as by developing the first polymer layer 90 to provide ink channels 48, ink chambers 46 and ink feed areas 104 in the first polymer layer (FIG. 12).

Figure 13:
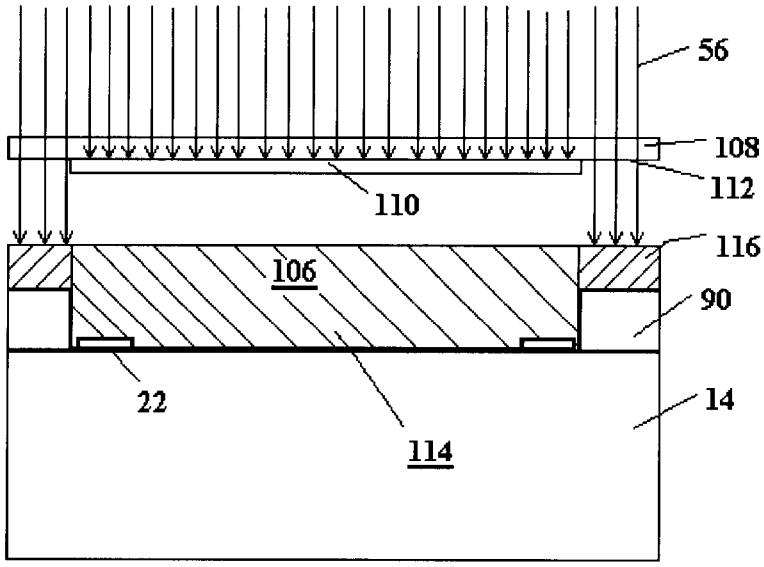

A positive photoresist material 106 is then applied to the first polymer layer 90 to fill the ink channels 48, ink chambers 46 and ink feed areas 104 formed in the first polymer layer 90. As with the first polymer layer 90, the positive photoresist material 106 may be spin-coated onto the first polymer layer 90. The thickness of the positive photoresist material 106 is preferably sufficient to fill the ink channels 48, ink chambers 46 and ink feed areas 104 up to at least the height of the first polymer layer 90 and to cover substantially all exposed areas of the first polymer layer 90 (FIG. 13). The thickness of the positive photoresist material 106 provides critical dimensions between the heater resistor 22 and the nozzle holes.

Figure 14:
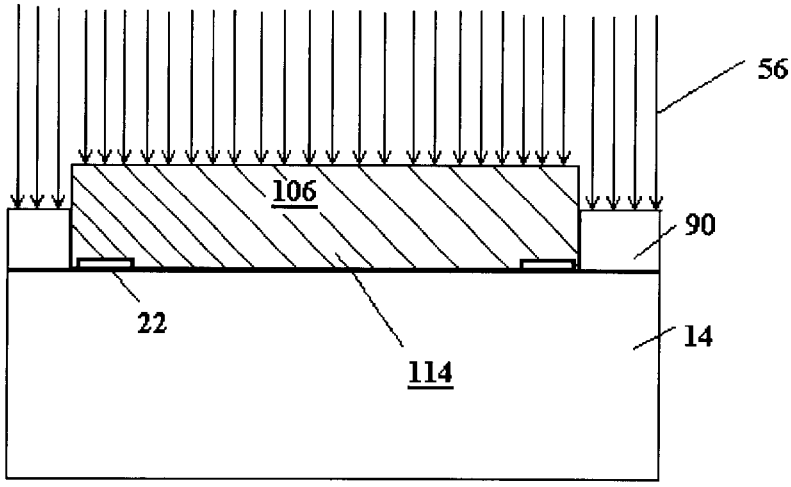

The positive photoresist material 106 is exposed to light radiation energy such as UV radiation 56 through a mask 108 having opaque areas 110 and transparent areas 112 to provide unexposed areas 114 filling the ink chambers 46, ink channels 48 and ink feed areas 104 and exposed areas 116 of the positive photoresist material 106. The exposed areas 116 of the positive photoresist material 106 are removed as by developing to provide ink chambers 46, ink channels 48 and ink feed areas 104 filled with the positive photoresist material 106 (FIG. 14). Light radiation energy such as UV radiation 56 is then applied to positive and negative photoresist materials 106 and 90 on the chip surface 28 so that the positive photoresist material 106 remaining on the chip 14 in the ink flow chamber 46, flow channel 48 and feed area 104 may be removed from the chip surface 28 in a subsequent developing step.

Figure 15:
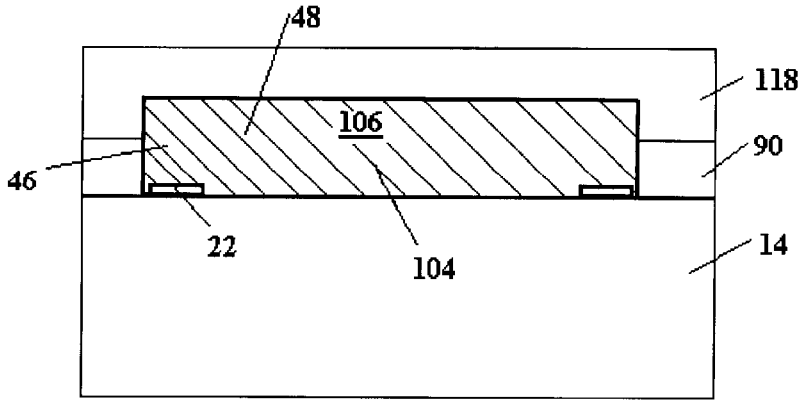
Figure 16:
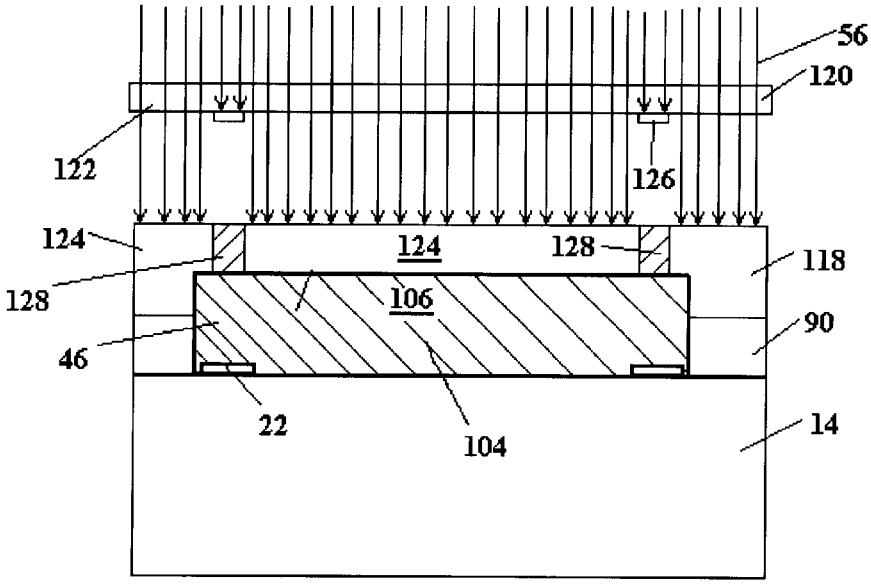
Figure 17:
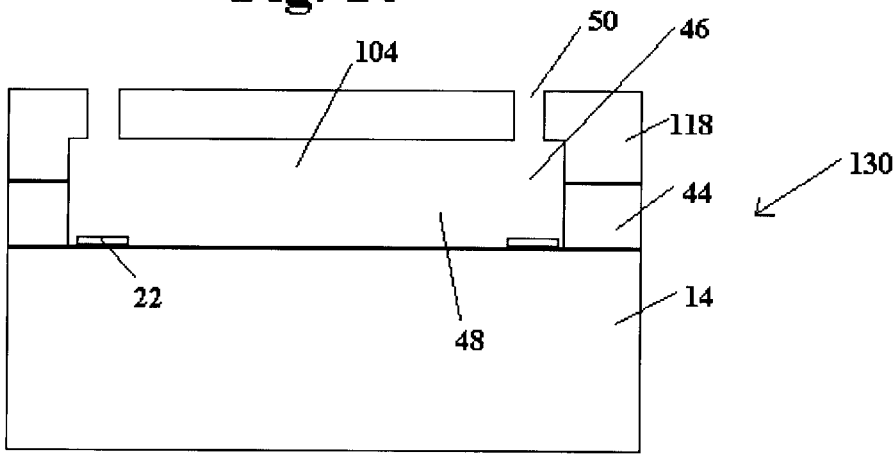

A second negative photoimageable material is applied by spin-coating or laminating the second material to the exposed positive photoresist material 106 and the first polymer layer 90. If applied as a liquid, the second photo-imageable material is dried using heat to provide a second photo-imageable polymer layer 118 (FIG. 15). The second polymer layer 118 is exposed to light radiation energy such as UV radiation 56 through a mask 120 having transparent areas 122 to provide exposed areas 124 and opaque areas 126 to provide unexposed areas 128 corresponding to nozzle hole locations in the second polymer layer 118 (FIG. 16). The unexposed areas 128 are developed and removed from the second polymer layer 118 to provide nozzle holes 50 in the second polymer layer 118. The positive photoresist material 106 filling the ink channels 48, ink chambers 46 and ink feed areas 104 is also removed as by developing techniques through the nozzle holes 50 or an ink via 24 in the chip 14 formed by dry etching as described above to provide a plurality of nozzle plate/chip assemblies 130 (FIG. 17) on the wafer.

In this embodiment, the ink vias 24 may be formed before or after applying the first polymer layer 90 and positive photoresist material 106 to the surface 28 of the substrate 12. If the vias 24 are formed prior to applying layer 90 and material 106 to the substrate 12, a positive photoresist material such as material 106 may be used to fill the ink vias 24 prior to applying the negative photoresist material to the surface 28. The positive photoresist material filling the ink vias 24 will be removed with the positive photoresist material 106 in the developing step.

As described above, the wafer is diced to remove a plurality of nozzle plate/chip assemblies 130 from the wafer. Flexible circuits or TAB circuits such as TAB circuit 32 (FIG. 1) are attached to the nozzle plate/chip assemblies 130 to provide printhead assemblies. The printhead assemblies are attached as by adhesives to a printhead body to provide an ink jet printhead.

It will be recognized that a wide variety of other materials which solidify may be used in place of the positive photoresist material 106 to fill the ink chambers 46, ink channels 48 and ink feed areas 106. Such alternate materials include waxes, water soluble materials such as polyvinyl alcohol, solvent dissolvable polymers and the like.

Having described various aspects and embodiments of the invention and several advantages thereof, it will be recognized by those of ordinary skills that the invention is susceptible to various modifications, substitutions and revisions within the spirit and scope of the appended claims.

What is claimed is:

1. A printhead for an ink jet printer, comprising a silicon semiconductor substrate containing ink ejection devices and a dry-etched ink via therein, a first photo-imaged polymer layer applied to the semiconductor substrate, the first photo-imaged polymer layer being patterned and developed to contain ink flow chambers and ink flow channels corresponding to the ink ejection devices on the semiconductor substrate and a second photo-imaged polymer layer applied to the first photo-imaged polymer layer, the second photo-imaged polymer layer being patterned and developed to contain nozzle holes corresponding to the ink chambers in the first photo-imaged polymer layer and corresponding to the ink ejection devices on the semiconductor substrate.

2. The printhead of claim 1 wherein the first polymer layer comprises a spin-coated photoresist layer.

3. The printhead of claim 2 wherein the first polymer layer has a thickness ranging from about 2 to about 75 microns.

4. The printhead of claim 1 wherein the second polymer layer comprises a spin-coated photoresist layer.

5. The printhead of claim 4 wherein the second polymer layer has a thickness ranging from about 2 to about 75 microns.

6. The printhead of claim 1 wherein the ink ejection devices comprise heater resistors.

7. The printhead of claim 1 wherein the ink ejection devices comprise piezoelectric devices.

8. The printhead of claim 1 wherein the first polymer layer has a thickness ranging from about 2 to about 75 microns.

9. The printhead of claim 1 wherein the second polymer layer has a thickness ranging from about 2 to about 75 microns.

10. A method for making a printhead for an ink jet printer, the method comprising the steps of:

providing a plurality of semiconductor devices on a silicon wafer, the wafer having a first surface and a second surface, the first surface of the wafer containing ink ejecting devices thereon;

applying a first photo-imageable polymer layer to the first surface of the silicon wafer;

exposing the first photo-imageable polymer layer to sufficient light radiation energy to provide a latent image of ink chambers and ink channels therein corresponding to the ink ejection devices;

applying a second photo-imageable polymer layer to the first photo-imageable polymer layer;

exposing the second photo-imageable polymer layer to sufficient light radiation energy to provide a latent image of nozzle holes therein corresponding to the ink ejection devices;

applying a masking layer to the second surface of the silicon wafer;

exposing and developing the masking layer to provide at least one ink via pattern to be etched in the silicon wafer;

dry etching through the silicon wafer up to the first polymer layer to form at least one ink via per semiconductor device;

developing the patterns in the first and second polymer layers to provide ink flow features and nozzle holes in the first and second polymer layers;

dicing the wafer to form a plurality of nozzle plate/substrate assemblies; and attaching at least one of the nozzle plate/substrate assemblies to an electrical circuit and to a printhead body to form an ink jet printhead.

11. The method of claim 10 where in the first and second polymer layers are spin-coated onto the silicon wafer.

12. The method of claim 11 wherein the first polymer layer is applied to the silicon wafer with a thickness ranging from about 2 to about 75 microns.

13. The method of claim 12 wherein the second polymer layer is applied to the silicon wafer with a thickness ranging from about 2 to about 75 microns.

14. The method of claim 10 wherein dry-etching the silicon wafer comprises deep reactive ion etching the silicon wafer.

15. The method of claim 10 further comprising removing the masking layer from the second surface of the silicon wafer.

16. The method of claim 10 wherein the masking layer comprises a silicon dioxide layer.

17. An ink jet printhead made by the method of claim 10.

18. A method for making a printhead for an ink jet printer, the method comprising the steps of:

providing a semiconductor wafer containing a plurality of printhead chips, the wafer having a device surface and a second surface opposite the device surface;

applying a first negative photoimageable material to the device surface of the wafer;

drying the first negative photoimageable material to provide a first polymer layer;

exposing the first polymer layer to light radiation energy through a mask to provide exposed and unexposed areas in the first polymer layer;

removing the unexposed areas from the first polymer layer to provide ink channels and ink chambers in the first polymer layer;

applying a positive photoresist material to the first polymer layer to fill the ink channels and ink chambers in the first polymer layer;

exposing the positive photoresist material to light radiation energy to provide unexposed areas filling the ink chambers and ink channels and exposed areas of the positive photoresist material;

removing the exposed areas of the positive photoresist material from the first polymer layer;

applying a second negative photoimageable material to the first polymer layer and the unexposed positive photoresist material;

drying the second negative photoimageable material to provide a second polymer layer;

exposing the second polymer layer to light radiation energy through a mask to provide unexposed areas corresponding to nozzle hole locations in the second polymer layer;

removing the unexposed areas from the second polymer layer to provide nozzle holes in the second polymer layer;

removing the positive photoresist material filling the ink channels and ink chambers from the wafer;

dicing the wafer to provide a plurality of nozzle plate/chip assemblies;

connecting a flexible circuit or tape automated bonding (TAB) circuit to the nozzle plate/chip assemblies to provide a plurality of printhead assemblies; and attaching at least one of the printhead assemblies to a printhead body to provide an ink jet printhead.

19. The method of claim 18 wherein the first and second negative photoresist materials are spin-coated onto the device surface of the wafer.

20. The method of claim 18 wherein the first and second negative photoresist materials are spin-coated onto the wafer with a thickness ranging from about 2 to about 75 microns.

21. The method of claim 18 further comprising dry-etching ink vias in the wafer prior to removing the positive photoresist material filling the ink channels and ink chambers from the wafer.

22. The method of claim 21 wherein dry-etching the ink vias in the wafer is conducted by deep reactive ion etching (DRIE).

23. A printhead made by the method of claim 22.

24. The method of claim 18 wherein the ink vias are formed in the semiconductor wafer by dry etching or grit blasting and the ink vias are filled with a positive photoresist material prior to applying the first negative photo-imageable material to the device surface of the wafer.

* * * * *